United States Patent [19]
Steigelmann
[11] 4,166,723
[45] Sep. 4, 1979

[54] GELLED HYDROCARBON FUELS

[75] Inventor: Edward F. Steigelmann, Park Forest, Ill.

[73] Assignee: Standard Oil Company (Indiana), Chicago, Ill.

[21] Appl. No.: 475,969

[22] Filed: Jul. 30, 1965

[51] Int. Cl.² ..... C10L 7/00
[52] U.S. Cl. ..... 44/7 A
[58] Field of Search ..... 44/7, 7 A; 149/18, 109

[56] References Cited

U.S. PATENT DOCUMENTS

| | | | |
|---|---|---|---|
| 2,386,804 | 10/1945 | Laliberte | 44/7 |
| 2,492,173 | 12/1949 | Mysels | 44/7 |
| 2,570,990 | 10/1951 | Southern et al. | 44/7 |
| 2,606,107 | 8/1952 | Fieser | 44/7 |
| 2,618,536 | 11/1952 | Hunn | 44/7 |
| 2,922,799 | 1/1960 | Baumgartner | 44/7 A |
| 3,047,602 | 7/1962 | Schenck | 44/7 A |
| 3,323,883 | 6/1967 | Hotten | 44/7 A |

*Primary Examiner*—Edward A. Miller
*Attorney, Agent, or Firm*—Edwin C. Lehner; Arthur G. Gilkes; William T. McClain

[57] ABSTRACT

Gelled fuel compositions having improved burning characteristics comprise a normally liquid petroleum fuel boiling in the range of about 100°-600° F.; a gelling agent; and about 0.5-20 volume percent acetic anhydride.

9 Claims, 1 Drawing Figure

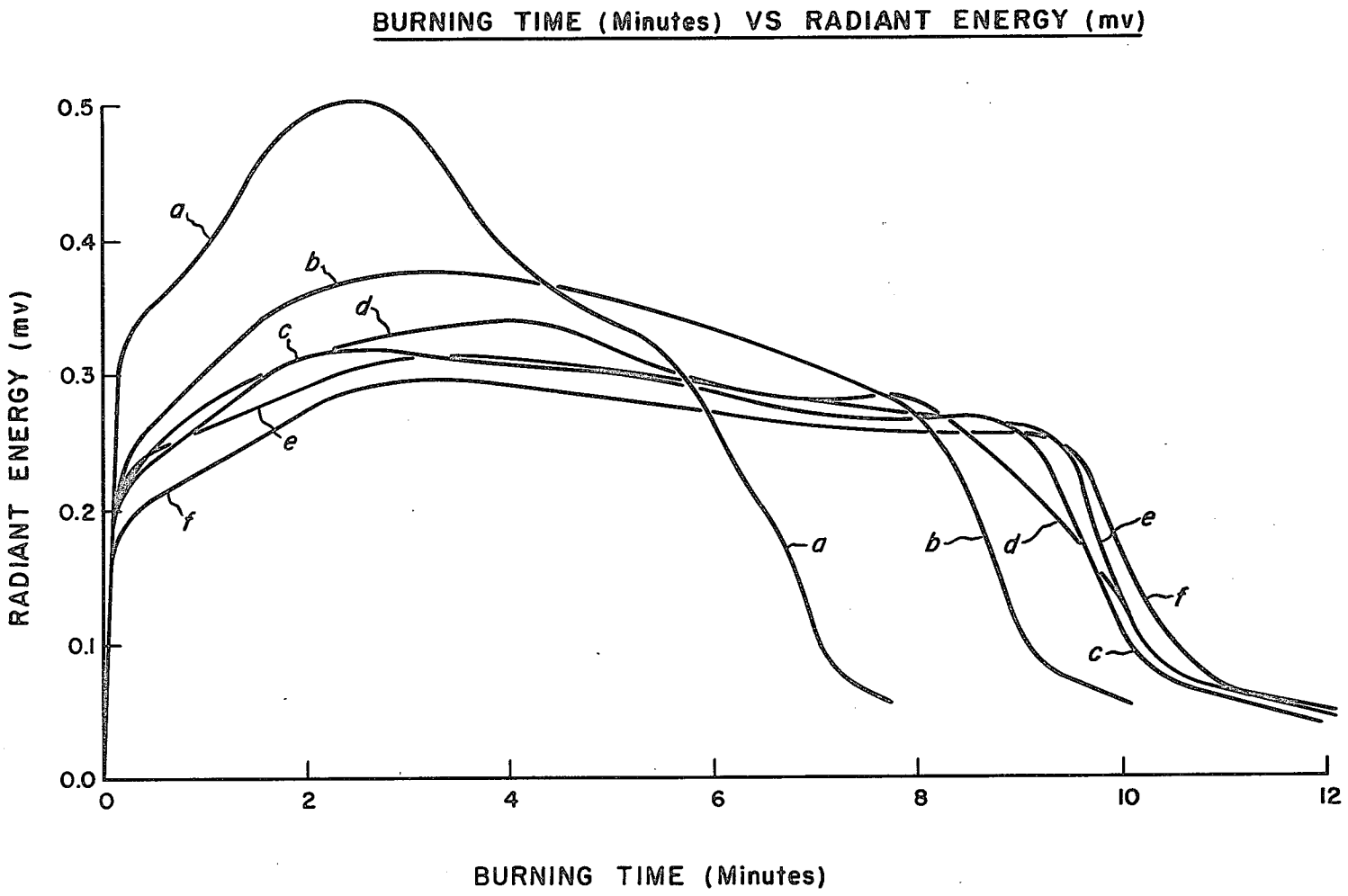
BURNING TIME (Minutes) VS RADIANT ENERGY (mv)
RADIANT ENERGY (mv)
0.5
0.4
0.3
0.2
0.1
0.0
0
2
4
6
8
10
12
BURNING TIME (Minutes)
a
b
c
d
e
f

GELLED HYDROCARBON FUELS

The invention herein described was made in the course of or under a contract or subcontract thereunder with Department of the Army.

This invention relates to gelled fuels. More particularly, it relates to a gelled fuel comprising normally liquid hydrocarbons.

Gelled normally liquid hydrocarbon fuels have been well known for a considerable period of time. These fuels are commonly referred to as napalm. These fuels are prepared by admixing a gelling or thickening agent at a relatively low concentration with the liquid fuel to form stable gels of relatively high consistency. Such solidified or gelled liquids, which are commonly referred to as incendiary gels, have many uses which are well known to the art. Such fuels are useful as charges for incendiary bombs, grenades, flame throwers, and the like. The effectiveness of gelled fuels as incendiary agents is determined by their ability to ignite targets. The burning or combustion characteristics are of extreme importance in the target igniting ability of a gelled fuel. A fast burning rate and a long burning time are essential features of the burning characteristics of a gelled fuel. At the present time napalm has a very fast burning rate but of a relatively short burning time. With longer burning times, more heat is transferred to the target and thus makes it a more effective incendiary weapon.

I have discovered that the incorporation of acetic anhydride in gelled fuels substantially improves the burning characteristics of such fuels. The effective burning time for releasing effective radiant energy from the burning fuel is substantially inproved by the incorporation of about 0.5–20, preferably about 2–10, volume percent acetic anhydride in the gelled fuel. The amount of acetic anhydride is based upon the amount of liquid hydrocarbon present in the gelled fuel.

The normally liquid hydrocarbons that are suitable for the preparation of a gelled hydrocarbon boil between about 100° F. and about 600° F. according to the ASTM distillation procedure. Examples of these normally liquid hydrocarbons are naphtha, clear gasoline, leaded gasoline (motor and aviation), kerosene, jet fuel, diesel fuel, and heater oil.

The gelled fuels of this invention are prepared by incorporating a gelling agent into a normally liquid hydrocarbon. The amount of gelling agent will vary depending on the consistency of the gel desired, the composition of the gelling agent, and the type of normally liquid hydrocarbon to be gelled. Generally, suitable gels are obtained at concentrations of the gelling agent of from about 0.5 to about 20 weight percent based on the gelled hydrocarbon. For most military uses, the gelled hydrocarbon will contain about 3–7 weight percent of the gelling agent.

Gelling agents suitable for preparing the gelled fuels of the invention are well known. Typically, these are metallic soaps of fatty acids such as stearic, oleic, palmitic, coconut oil acids, napthenic acids, et seq., and mixtures of the same. The preferred soap is a basic aluminum alkanoate. Illustrative of these soaps are the materials described in U.S. Pat. Nos. 2,390,609; 2,618,536; 2,751,359; and 2,751,360.

The gelled normally liquid hydrocarbon fuels of this invention, containing an amount of acetic anhydride sufficient to improve the burning characteristics of said fuel, can be prepared in any known manner. Preferably, these fuels are prepared by admixing the normally liquid hydrocarbon and the acetic anhydride together to form a liquid hydrocarbonacetic anhydride mixture and then thickening said mixture with the gelling agent to form the gelled fuel of the desired consistency.

The improvement obtained in the burning characteristics of napalm fuel is illustrated by the following example. Since gasoline, both clear and leaded, is readily available in the field as the combustible fuel used for making napalm, a regular grade leaded gasoline was chosen as the representative normally liquid hydrocarbon boiling in the range of about 100°–600° F. to ascertain whether acetic anhydride was an effective additive to improve the burning characteristics of napalm prepared therefrom. In this test, a series of gels were prepared by mixing leaded gasoline with and without the additive and 5 grams of napalm M-1 soap for each 100 ml of fuel at room temperature. The control, sample A, consisted only of the gasoline and the soap. Gasoline-acetic anhydride fuel mixtures containing 2, 3, 4, 5, and 6 volume percent acetic anhydride, identified as samples B, C, D, E, and F respectively, were prepared. These fuel mixtures were each gelled with 5 grams of the M-1 soap. The M-1 soap is the commercial napalm thickener which is a hydroxy aluminum soap of a mixture of fatty acids consisting of about 25 parts naphthenic acid, 25 parts oleic acid, and about 50 parts coconut oil acids. Each of the samples were aged for 24 hours prior to burning to determine their burning characteristics.

The normal procedure for determining the burning characteristics of napalm is to form a corner from 3 pieces of plywood, place a weighed amount of gelled fuel in the corner and ignite it. After the fuel has been consumed, the burned plywood pieces are visually examined and the extent and manner of burning of the wood surfaces is thus qualitatively determined. Such test procedures are ineffectual for quantitatively measuring the effective energy and the time during which it is released from the fuel during its burning period. It was found that it is possible to quantitatively determine the burning characteristics of napalm fuels by measuring the total radiant energy given off by a burning sample in an evaporating dish. This measurement is accomplished by the combination of a thermopile detector and a continuous recording potentiometer. The electromotive force generated by the thermopile detector was recorded as a function of time.

The burning characteristics of samples A-F were determined by burning 10 grams of each sample in an evaporating dish. The total radiant energy was measured by a thermopile placed about 65 cm. from the evaporating dish and the electromotive force recorded as millivolts (mv) on the continuous strip chart of the recording potentiometer. The quantitative burning characteristics are thus shown by the curves obtained. Smoothed time versus radiant energy curves for each of the samples A-F were prepared from the aforesaid strip chart curves and are reproduced in the attached drawing. In the drawing, each of the curves labled a-f correspond to the radiant energy smooth curves obtained by the burning of the corresponding samples A-F.

The manner in which the energy in the fuel is released as it is burning is of prime importance. Fuels that release a high initial peak energy during a relatively short period of time are unsatisfactory incendiary fuels where the objective it to ignite a given target. The satisfactory utilization of napalm depends on the burning and contact time as well as the effective energy released during that time period. It is desired that the effectual energy be released during burning at a relatively uniform rate during the effective burning time. Such burning characteristic transmits more effective heat to a given object during its contact time. Such desired burning characteristics is clearly achieved in napalm fuels prepared in accordance with this invention. The desired result is shown clearly in curves b-f. Curve a shows that conventional napalm quickly releases its energy in a relatively short period of time. Curves b-f show that acetic anhydride substantially modifies the manner in which the energy is released from the burning fuel. The effective burning time of the napalm is increased by about 30–55 percent by the inclusion of acetic anhydride therein. Thus, acetic anhydride improved the burning characteristics of gelled fuels.

Acetic anhydride has been found to be a unique additive for improving the burning characteristics of gelled fuels. Similar tests conducted with other compounds, including acetic acid and such derivatives thereof as acetamide, t-butyl acetate, peracetic acid, acetaldehyde, acetyl chloride, and ethyl acetate, were found to be ineffectual additives.

I claim:

1. A gelled fuel comprising:
(a) a major amount of a normally liquid petroleum fraction boiling in the range of about 100°–600° F.;
(b) from about 0.5 to about 20 weight percent of a gelling agent; and
(c) from about 0.5 to about 20 volume percent of acetic anhydride.

2. The fuel of claim 1 wherein said gelling agent is a metal soap.

3. The fuel of claim 1 wherein said petroleum fraction is gasoline.

4. The fuel of claim 4 wherein the amount of said anhydride is about 2–6 volume percent.

5. A gelled fuel comprising:
(a) a major amount of a normally liquid petroleum fraction boiling in the range of about 100°–600° F.;
(b) from about 0.5 to about 20 weight percent of basic aluminum soap; and
(c) from about 0.5 to about 20 volume percent of acetic anhydride.

6. The fuel of claim 5 wherein said petroleum fraction is gasoline; the amount of said soap is about 5 percent, said soap being a hydroxy aluminum soap of a mixture of fatty acids consisting of about 25 parts naphthenic aicd, 25 parts oleic acid, and about 50 parts coconut acids; and the amount of said anhydride is about 2–6 percent.

7. The method of preparing gelled hydrocarbon fuels having improved burning characteristics which comprises admixing normally liquid hydrocarbon and acetic anhydride to form a liquid hydrocarbon-acetic anhydride mixture containing about 0.5–20 volume percent of said anhydride; and thickening said mixture with an amount of basic aluminum soap sufficient to form a gelled fuel.

8. The method of claim 7 wherein said hydrocarbon is a normally liquid petroleum fraction boiling in the range of about 100°–600° F.

9. The method of claim 8 wherein said hydrocarbon is gasoline; said liquid mixture contains about 2–6 percent of said anhydride; and the amount of said soap is about 5 weight percent, said soap being a hydroxy aluminum soap of a mixture of fatty acids consisting of about 25 parts naphthenic acid, 25 parts oleic acid, and about 50 parts coconut acids.

* * * * *

UNITED STATES PATENT OFFICE

CERTIFICATE OF CORRECTION

Patent No. 4,166,723 Dated September 4, 1979

Inventor(s) Edward F. Steigelmann

It is certified that error appears in the above-identified patent and that said Letters Patent are hereby corrected as shown below:

Column 4, line 3, claim reference numeral "4" should read --3--; line 16, "aicd" should read --acid--.

Signed and Sealed this

*Fifteenth* Day of *January 1980*

[SEAL]

*Attest:*

SIDNEY A. DIAMOND

*Attesting Officer*

*Commissioner of Patents and Trademarks*